US005592898A

United States Patent [19]

Korpi

[11] Patent Number: 5,592,898

[45] Date of Patent: Jan. 14, 1997

[54] LANE MARKER

[75] Inventor: John G. Korpi, Livonia, Mich.

[73] Assignee: The United States of America as represented by the Secretary of the Army, Washington, D.C.

[21] Appl. No.: 387,003

[22] Filed: Feb. 10, 1995

[51] Int. Cl.[6] ..... E01F 9/016; E01F 9/019

[52] U.S. Cl. ..... 116/209; 116/63 P; 116/202

[58] Field of Search ..... 116/63 P, 63 C, 116/202, 209; 40/610, 612; 362/34

[56] References Cited

U.S. PATENT DOCUMENTS

| | | | |
|---|---|---|---|
| 2,275,711 | 3/1942 | Ybanez | 116/63 C |
| 3,132,624 | 5/1964 | Shoemaker, Jr. | 116/63 C |
| 4,959,756 | 9/1990 | Dodson | 362/34 |
| 4,969,398 | 11/1990 | Lundwall | 102/293 |
| 5,269,251 | 12/1993 | Freeman | 116/63 C |

*Primary Examiner*—William A. Cuchlinski, Jr.
*Assistant Examiner*—Willie Morris Worth
*Attorney, Agent, or Firm*—Peter A. Taucher; David L. Kuhn

[57] ABSTRACT

A lane marker includes a base, an illuminator, and a frangible bracket releasably holding the illuminator in the lowered position on the base. A cantilever embedded in the bracket extends therefrom along the illuminator and is stronger than the bracket. The marker also includes a vertically expandable spring whose coils are compressed in a planar array against the base, one section of the spring biasing the illuminator to swing up from the lowered position. A keeper section of the spring connects to the illuminator and bears on the coils to keep them compressed against the base. An end of the keeper section latches to the base until the frangible bracket is broken. When the bracket breaks, the spring swings up the keeper section along with the illuminator so as to free the keeper section's end from the base.

9 Claims, 3 Drawing Sheets

LANE MARKER

GOVERNMENT USE

The invention described here may be made, used and licensed by or for the U.S. Government for governmental purposes without paying me royalty.

BACKGROUND AND SUMMARY

One of the most difficult and dangerous operations on a battlefield is clearing paths through mine fields, especially when done under enemy fire. Hence, mines are typically cleared by a crew in a tank fitted with devices to remove or explode mines ahead of the tank as it crosses a mined area. It is critical to plainly mark lanes cleared by tanks so that soldiers or other vehicles can accurately follow them. The US Army has a tank-mounted dispenser that deploys lane markers along a cleared path automatically, so that personnel need not be exposed to enemy fire or nearby mine explosions to mark cleared lanes. The dispenser uses lane markers that have a flat, relatively compact shape when in the dispenser. Present lane markers that fit into the dispenser have a lighted element that is raised less than one foot from the ground upon marker deployment. It is desired to have an automatically deployable marker wherein the lighted element is higher off the ground, so that the lane marker is more visible.

My invention is an improved automatically deployable lane marker that addresses the above concern. The marker has an illuminator connected by a spring to a generally planar base, the illuminator having a prone pre-deployment position where the illuminator lies along or in the general plane of the base. The illuminator has a post-deployment position where the spring has swung the illuminator upright and has raised the illuminator about three feet from the base. The spring has coils compressed into a planar array atop the base before deployment, the coils expandable to raise the illuminator. A leg of the spring connects the coils to the illuminator and biases the illuminator from the prone to the upright position. The spring has a keeper retaining the coils in compression against the base before deployment. Attached to the keeper is an end section that passes through a hole in the base and holds the keeper to the base.

The lane marker has a destructible bracket holding the illuminator in its prone position against the bias of the spring's leg, and a cantilever extends from the bracket along the illuminator. Just before the marker deploys, an impactor moves the cantilever while crushing an ampule of light activator agent in the illuminator. The cantilever breaks the bracket, and then the spring swings the illuminator upright and raises the illuminator from the base.

DETAILED DESCRIPTION

Figure 1:
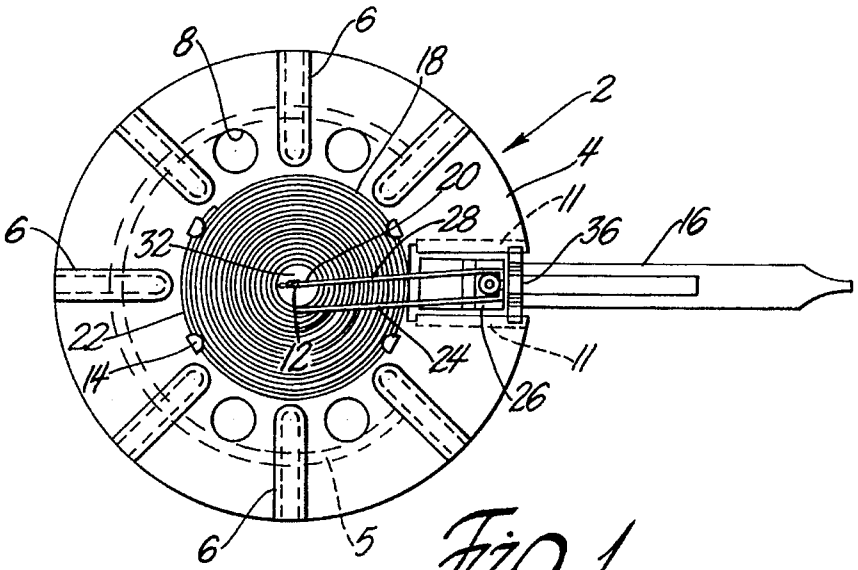
FIG. 1 is a top elevational view of my lane marker.
Figure 3:
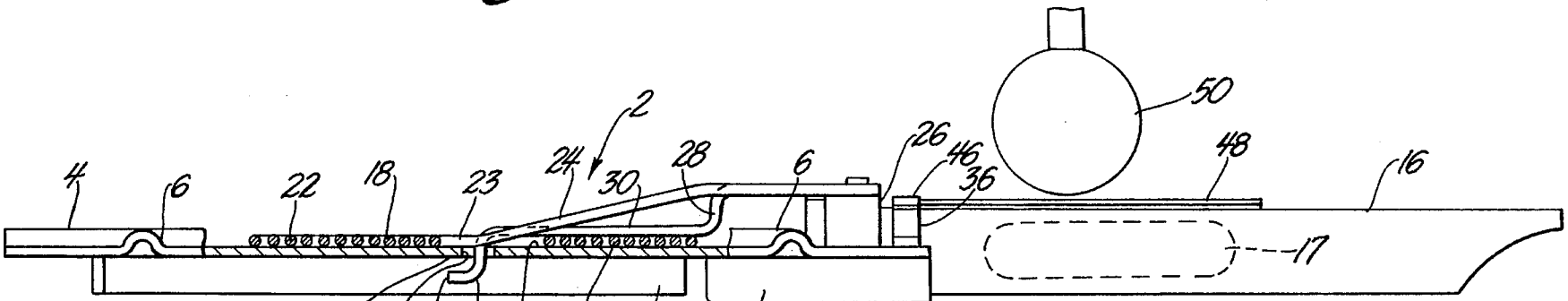
FIG. 3 is a partly sectioned side elevational view of my marker in a pre-deployment configuration.

Automatically dispensable marker 2 in FIGS. 1 and 3 includes base 4, spring 18 fixed to the base, a known light stick or illuminator 16 fastened to spring 18 by snap retainer 26, and a frangible bracket 36 holding illuminator 16 to base 4. Spring 18 is normally an integral unit made from a single piece of wire or wire-like stock. It is preferred that the base is heavier than the combination of the illuminator, the snap retainer and the spring. Marker 2 is normally used to mark lanes of passage for land vehicles but can be used to denote any geographical area, such as a crash site.

Figure 2:
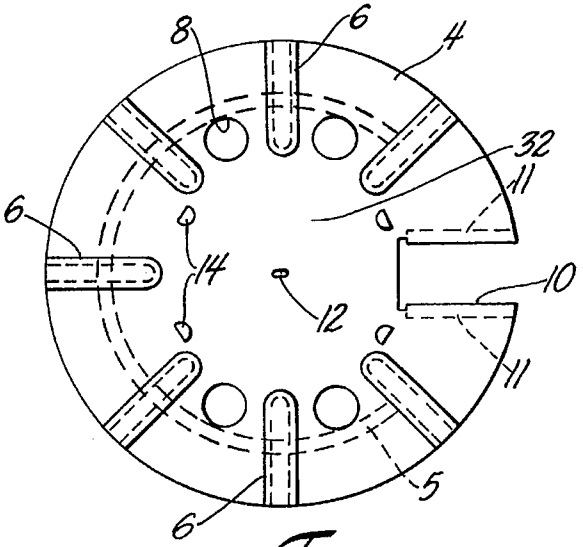
FIG. 2 is a top elevational view of the lane marker's base.
Figure 10:
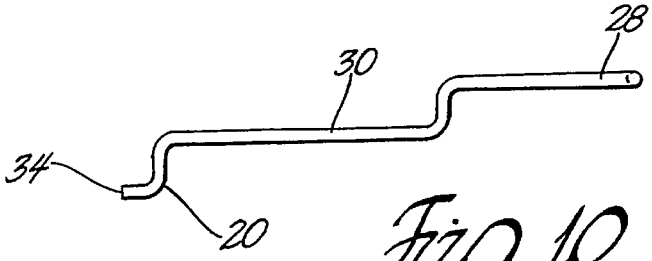

A mainly conventional base 4 is a generally wide flat stamped metal plate shown alone in FIG. 2, the base having an obverse or upper surface 32 and an opposed ground engaging or reverse surface 38. Base 4 has several radial stiffening ridges 6 and has a plurality of round apertures 8. A wide slot 10 in base 4 accommodates one end of illuminator 16 when the illuminator is prone or lowered as in FIGS. 1 and 3. As seen in FIG. 3, the illuminator has internal ampule 17 which, when broken, releases a reagent inside the illuminator to produce light. Base 4 is unconventional in that it has oval aperture 12 which accepts end section 20 of spring 18 (FIGS. 2 and 10), and has tabs 14 which retain spring 18 on the base. On the reverse or ground engaging side of base 4 is a wall 5 defining an arc of approximately 270°, the wall also defining a gap adjacent slot 10. Also on the reverse side of base 4 are flanges 11 at opposed edges of slot 10.

Figure 9:
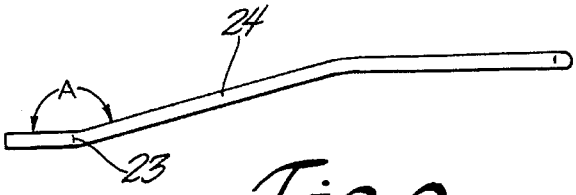
FIGS. 9 and 10 show details of the spring.

In FIGS. 1 and 3, an expandable coiled section 22 of spring 18 is compressed so that concentric coils of section 22 form a planar array about aperture 12, the array faced against the obverse surface 32. Individual coils may be immediately adjacent one another as in FIG. 1, or these coils may define radial gaps therebetween. Extending from the innermost coil into connection with snap retainer 26 is the spring's flexible leg section, 24, which is shown alone in FIG. 9. Fixed to snap retainer 26 is the spring's latch section 28, which is typically integral with section 24 and which is shown by itself in FIG. 10. Latch section 28 has a keeper in the form of segment 30 that bears on coiled section 22 to keep section 22 in compression against obverse surface 32. Segment 30 is typically straight and parallel to surface 32. Adjacent the spring's leg section 24 is generally S-shaped end section 20, which passes through aperture 12. The terminus 34 of section 20 is below and opposed to a region of the base's reverse surface 38 that is adjacent aperture 12. Reverse surface 38 blocks upward movement of section 20 so that the upward bias of coiled section 22 does not remove section 20 from aperture 12.

Figure 4:
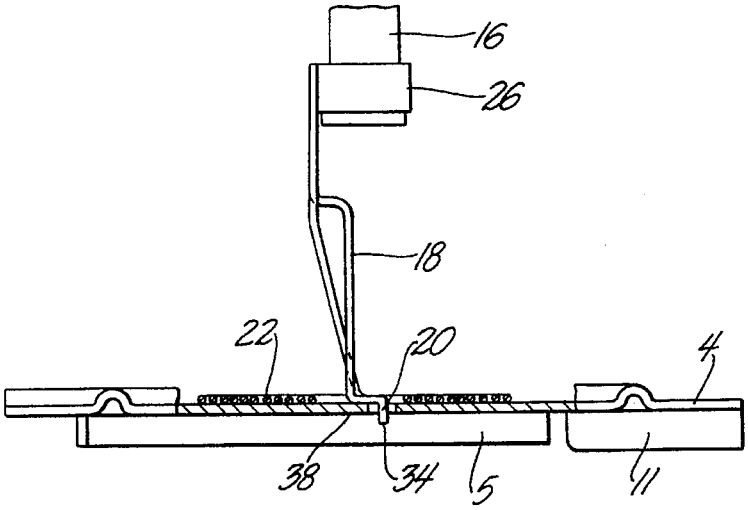
FIG. 4 is a partly sectioned side elevational view of my marker with the illuminator upright.

Spring 18 is biased at bend 23 (FIG. 9) to lift or swing leg section 24 and latch section 28 together from their generally horizontal orientation in FIG. 3 to their generally vertical orientation in FIG. 4. The upward swing of latch section 28 rotates end section 20 and terminus 38 approximately 90 degrees and thereby aligns section 20 and terminus with aperture 12 at a position below the aperture. The end section and terminus are now clear of reverse surface 38, so that coiled section 22 can expand to lift illuminator 16, latch section 28 and leg section 24 from base 4. Typically during the aforementioned lift or swing, the 160° to 170° angle "A" (FIG. 9) formed by bend 23 will close to 70° or 80°.

Normally leg section 24 and latch section 28 are fixed in their horizontal orientation by a series of mechanical connections. First in this series is the connection between these sections and snap retainer 26. Second is the clasp or grip of snap retainer 26 on illuminator 16, and third is the connection between illuminator 16 and base 4 effected by bracket 36.

Figure 5:
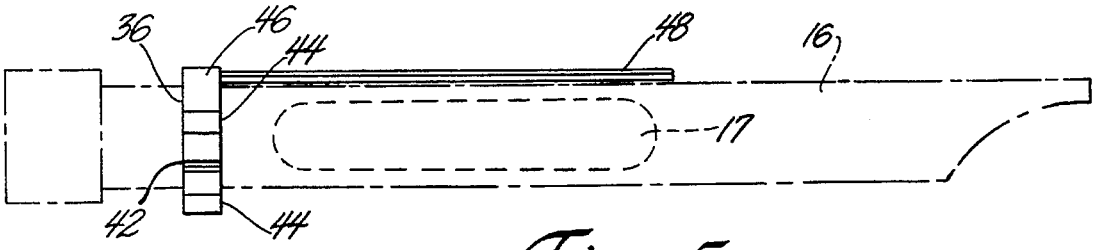
FIGS. 5 and 6 are respectively a side elevational view and an end elevational view of a frangible bracket used on my lane marker, structure around the bracket being shown by dashed lines.
Figure 6:
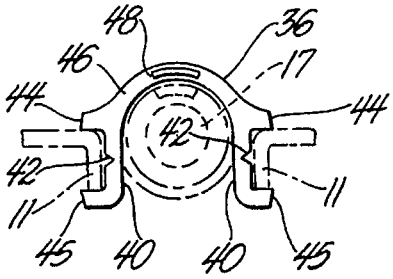

In FIGS. 5 and 6 are shown details of bracket 36, which is a destructible means to releasably hold illuminator 16 in its FIG. 3 position adjacent base 4. Bracket 36 is an inelastic, frangible, generally U-shaped element that is weaker than flanges 11, retainer 26, and illuminator 16. The bracket has opposed legs 40 faced, preferably lightly or loosely, against flanges 11 of base 4. From these legs extend spurs or projections 44 and 45 that, contact the tops and bottoms of flanges 11 so that the legs and spurs cooperate to conformingly track on the flanges. Legs 40 preferably loosely contact illuminator 16 and are joined by a bridge 46 which stops illuminator 16 from being swung upward by spring 16. Bracket 36 can be slid on flanges 11 in slot 10 and along illuminator 16 for easy installation on or removal from base 4 and the illuminator. Midway between the projections on legs 40 are detents 42 that create fracturable zones where the bracket can most easily be broken. Such fracture zones can be placed at other locations on bracket 36 as well. Embedded in and extending from bridge 46 is an elongate cantilever 48 disposed along illuminator 16 over ampule 17, cantilever 48 being stronger than the rest of bracket 36.

Figure 7:
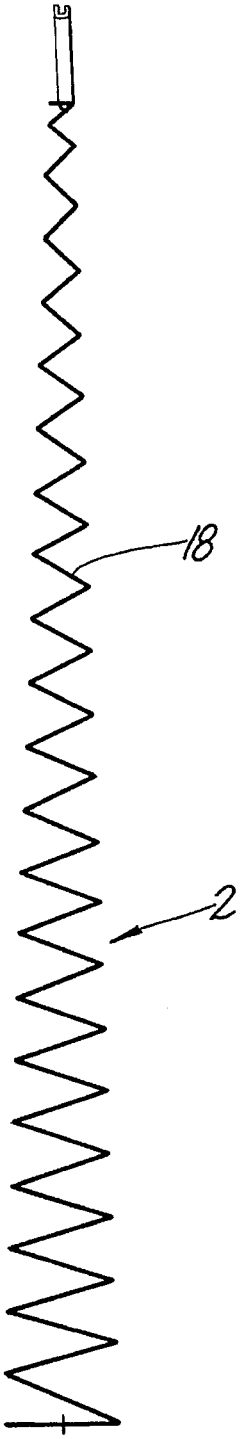
FIG. 7 schematically shows a spring used on my lane marker in the spring's free, fully vertically expanded state.
Figure 8:
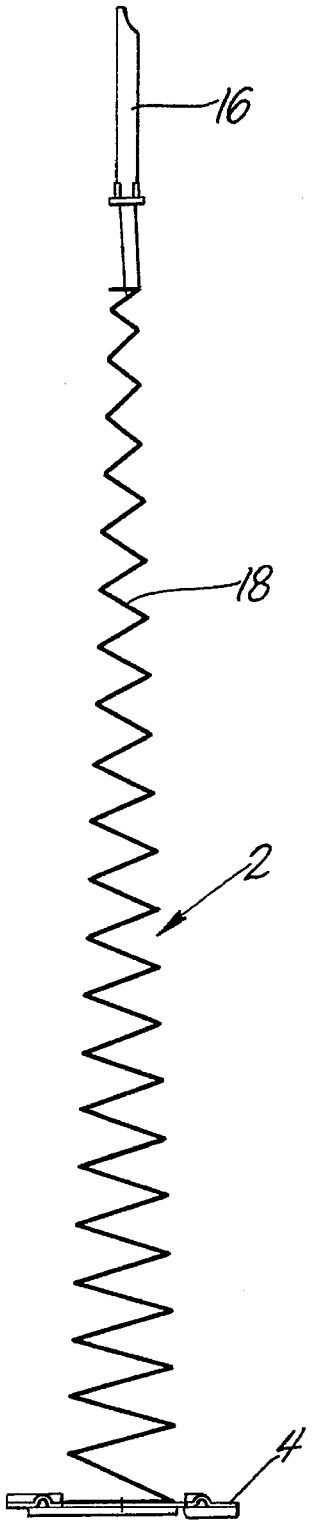
FIG. 8 is a side view if my lane marker in the final deployed configuration, the spring shown schematically.

Just before deployment of lane marker 2, impactor 50 (FIG. 3) of an automatic dispenser (not shown) deforms illuminator 16 so as to crush ampule 17, whereupon the ampule releases a reagent that causes the illuminator to glow. When crushing the ampule, impactor 50 also causes cantilever 48 to move and break bracket 36 so that illuminator 16 is released from base 4. It is intended that bracket 36 will break at detents 42, so that projections 45 will separate from bracket 36, whereby the bracket will no longer prevent upward movement of illuminator 16. Once bracket 36 breaks, spring 18 swings illuminator 16 up from its FIG. 3 position, which is next to base 4 in or along the base's general plane. Illuminator 16 is swung by spring 18 until the illuminator arrives at its FIG. 4, vertical position. The spring's end section 20 is fixed relative to illuminator 16 and therefore rotates in concert with the upward swing of illuminator 16. After so rotating, section 20 passes upward through aperture 12 under the bias of the spring's coiled section 22. Coiled section 22 expands until base 4, spring 18, and illuminator 16 reach their final relative positions shown in FIG. 8. In the FIG. 8 configuration, lane marker 2 is typically three feet in height. The spring's final, free-state overall configuration is generally elongate and conical and is shown by itself in FIG. 7.

I wish it to be understood that I do not desire to be limited to the exact details of construction or method shown herein since obvious modifications will occur to those skilled in the relevant arts without departing from the spirit and scope of the following claims.

We claim:

1. An automatically deployable marker, comprising:

a base;

an illuminator in a position next to the base;

means for retaining the illuminator in the position next to base, the retaining means comprising a frangible element;

a cantilever extending from the frangible element along the illuminator, the cantilever being stronger than the frangible element;

a spring having one end secured to the base and having a first section compressed on the base, the first section biased to expand away from the base;

a second section of the spring connected between the first section and the illuminator, the second section biasing the illuminator to swing from the position next to the base;

a keeper having one end fixed to the illuminator, the keeper engaging and retaining the first section of the spring in compression on the base;

means for latching an end of the keeper opposite the illuminator to the base to maintain the keeper in engagement with the first section of the spring.

2. The marker of claim 1 wherein the frangible element comprises:

a pair of legs lightly engaging the base and having the illuminator therebetween;

a bridge joining the legs and blocking swing of the illuminator away from the base.

3. The marker of claim 2 wherein:

the base defines a slot;

the legs of the frangible element are slidably tracked with the slot and slidable along the illuminator.

4. The marker of claim 3 further comprising fracturable zones on the legs where the frangible element is most easily broken.

5. An automatically deployable geographic area marker, comprising:

a base having an obverse surface and a reverse surface opposed to the obverse surface;

an illuminator in a lowered position at the base;

destructible means engaging the base for releasably retaining the illuminator in a lowered position;

a spring having one end secured to the base and a coiled section compressed against the obverse surface, the coiled section disposed in a generally planer array of coils, wherein the spring is connected to the illuminator and biases the illuminator to swing upright from the lowered position;

a keeper section of the spring connected to the illuminator and bearing on the coiled section, whereby the coiled section is retained against the base;

means for releasably latching an end of the keeper opposite the illuminator to the base to maintain the keeper bearing on the coiled section on till deployment.

6. The marker of claim 5 wherein the latching means comprises an aperture in the base and an S-shaped end portion of the keeper section passing through the aperture and a terminus of the S-shaped end portion lying opposed to a portion of the reverse surface of the base.

7. The area marker of claim 6 wherein the S-shaped end portion is fixed relative to the illuminator and the terminus swings in concert with the illuminator, the terminus swingable into alignment with the aperture.

8. A geographic area marker, comprising:

a base having an obverse surface and a reverse surface opposed to the obverse surface, the base defining an aperture;

an illuminator in a lowered position at the base;

destructible means engaging the base for releasably retaining the illuminator in the lowered position, the destructible means comprising a frangible element;

a cantilever embedded in the frangible element and extending from the frangible element along the illuminator, the cantilever being stronger than the frangible element;

a spring having one end secured to the base and a coiled section compressed against the obverse surface, the coiled section disposed in a generally planer array of coils about the aperture;

a second section of the spring integral with the coiled section and connected to the illuminator, the second section biasing the illuminator to rotate up from the lowered position;

a keeper section of the spring having an S-shaped free end connected to the illuminator and bearing on the coiled section, whereby the coiled section is retained against the base;

means for releasably latching the keeper to the base wherein the aperture forms part of the latching means, and the latching means further comprises the S-shaped end portion of the keeper section passed through the aperture and fixed relative to the illuminator, and the latching means still further comprises a terminus of the S-shaped end portion opposed to a part of the reverse surface of the base.

9. The marker of claim 8 wherein the frangible element is a bracket slidably tracked with the base and slidable along the illuminator.

* * * * *